US005344287A

United States Patent [19]

Schaefer

[11] Patent Number: 5,344,287

[45] Date of Patent: Sep. 6, 1994

[54] FAN SHROUD ADAPTOR AND ASSEMBLY

[76] Inventor: Ronald E. Schaefer, 514 Tenth St. North, Sartell, Minn. 56377

[21] Appl. No.: 58,464

[22] Filed: May 6, 1993

[51] Int. Cl.[5] ..... F04D 29/52

[52] U.S. Cl. ..... 415/213.1; 454/205; 454/228

[58] Field of Search ..... 415/213.1; 454/205, 454/228, 234

[56] References Cited

U.S. PATENT DOCUMENTS

| | | | |
|---|---|---|---|
| D. 153,542 | 4/1949 | Owens et al. | D26/7 |
| 518,984 | 5/1894 | Zimmerman . | |
| 983,179 | 1/1911 | Swift . | |
| 1,447,776 | 3/1923 | Friedman et al. . | |
| 1,532,505 | 4/1925 | Lyon . | |
| 2,017,431 | 10/1935 | Anderson | 230/275 |
| 2,135,252 | 11/1938 | Grover | 415/213.1 |
| 2,259,853 | 9/1938 | Koch | 230/274 |
| 2,296,635 | 9/1942 | Foehrenbach et al. | 454/205 |
| 2,476,692 | 7/1949 | Bernstein | 416/246 |
| 2,565,122 | 8/1951 | Cowan | 98/118 |
| 2,617,583 | 11/1952 | Kemler | 230/275 |
| 2,624,504 | 1/1953 | Viewegh | 230/275 |
| 2,656,974 | 10/1953 | Holstein | 230/259 |
| 2,715,495 | 8/1955 | Bastian | 416/246 |
| 2,728,519 | 12/1955 | McLarty | 230/259 |
| 2,829,819 | 4/1958 | Corwin | 230/275 |
| 2,862,657 | 12/1958 | Copeland et al. | 230/273 |
| 3,081,690 | 3/1963 | Gesmar | 454/205 |
| 3,138,086 | 6/1964 | Rigterink et al. | 98/37 |
| 3,262,638 | 7/1966 | Militello | 230/275 |
| 3,299,798 | 1/1967 | Nabben | 98/119 |
| 3,307,469 | 3/1967 | Bohanon | 454/228 |
| 3,347,452 | 10/1967 | Radcliffe | 230/259 |
| 3,392,655 | 7/1968 | Chambers et al. | 454/228 |
| 3,787,142 | 1/1974 | Dupke | 416/247 |
| 3,791,333 | 2/1974 | Losch | 155/34 R |
| 3,963,382 | 6/1976 | Patton | 417/361 |
| 4,022,548 | 5/1977 | McLarty | 416/247 R |
| 4,222,318 | 9/1980 | Patton et al. | 98/94 |
| 4,498,373 | 2/1985 | Dittmer et al. | 98/33.1 |
| 4,657,485 | 4/1987 | Hartwig | 416/247 |
| 4,686,890 | 8/1987 | Stouffer et al. | 98/2 |
| 4,794,852 | 1/1989 | Ee | 98/118 |
| 4,811,656 | 3/1989 | Meendering | 98/37 |
| 4,818,183 | 4/1989 | Schaefer | 416/247 |
| 4,823,679 | 4/1989 | Robbins | 98/33.1 |
| 4,834,615 | 5/1989 | Mauch et al. | 415/213.1 |
| 4,850,265 | 7/1989 | Raisanen | 98/37 |
| 5,088,388 | 2/1992 | Schaefer | 454/271 |

FOREIGN PATENT DOCUMENTS

| | | | |
|---|---|---|---|
| 721777 | 6/1942 | Fed. Rep. of Germany | 415/213.1 |
| 355621 | 12/1905 | France . | |
| 2308873 | 11/1976 | France . | |
| 430480 | 6/1935 | United Kingdom | 415/213.1 |
| 1514459 | 6/1978 | United Kingdom . | |

*Primary Examiner*—John T. Kwon

*Attorney, Agent, or Firm*—Palmatier, Sjoquist & Helget

[57] ABSTRACT

A combination fan and fan shroud adaptor assembly includes a fan with a circumferential wall, front and rear grill faces and a driven fan blade between the faces and within the wall. The fan shroud adaptor has a substantially flat frame which is attachable or hinged to a building wall in confronting relationship with a building opening through the wall as to close the building opening. An opening is within the frame, slightly larger than the fan circumferential wall, for receiving and supporting the fan wall in close engagement with the frame and alignable with the building opening. Means may be located adjacent a lower portion of the frame opening for receiving and supporting the fan in the frame opening in a secure fashion for air exhaust, intake and circulation.

38 Claims, 4 Drawing Sheets

FAN SHROUD ADAPTOR AND ASSEMBLY

BACKGROUND OF THE INVENTION

This invention relates to air ventilation and circulation, and more particularly to a combination air circulation fan and fan shroud adaptor assembly for air intake, air circulation and air exhaust within a building.

Agricultural and horticultural buildings require attention to appropriately control the temperature, moisture and atmosphere therein throughout the fall, winter, spring and summer. Air intakes are known to adjustably permit volumes of fresh air to be drawn from the outside through the intake into a building typically by action of an exhaust fan.

It is well known that seasonal problems occur in controlling the atmosphere within poultry, dairy, hog, calf and horse barns or buildings. The air within such buildings becomes stagnant and ridden with ammonia, moisture and odors—all detrimental to the health and production of poultry and animals. In the summer, it is necessary to cool the buildings to prevent heat stress, to control flies and flying insects, and to maintain production levels of animals otherwise exposed to high temperatures. In the winter, agricultural buildings are typically plagued with inconsistent air temperatures throughout the buildings and cold air drafts exist which may be detrimental to poultry and animals. Further still, the ceilings, walls and floors of agricultural buildings in the winter are often damp with moisture or condensation.

In the past, agriculturalists and farmers have used integrated systems of variable speed exhaust fans, suitably controlled by thermostatically controlled speed modulators together with air intakes. Air intakes react to the withdrawal of air within the building by exhaust fans as well as the static pressure changes associated with enclosed buildings as they let fresh air into or out of the building. Such systems are complex and require a multiplicity of air intakes, exhaust fans and possibly also circulation fans in order to permit high velocity air exchange and circulation for cooling in the summer and gentle, draft-free air exchange and movement during the winter months.

There is a need for a combination circulation fan and fan shroud adaptor assembly which will permit the unit to work as an air intake, an air circulation fan and an air exhaust fan. The assembly should be readily convertible from one mode to another with minimal effort as well as not being too expensive but rather economical to manufacture and acquire.

SUMMARY OF THE INVENTION

A combination fan and fan shroud adaptor assembly includes a fan with a circumferential wall, front and rear grill faces and a driven fan blade between the faces and within the wall. The fan shroud adaptor has a substantially flat frame which is attachable or hinged to a building wall in confronting relationship with a building opening through the wall as to close the building opening. An opening is within the frame, slightly larger than the fan circumferential wall for receiving and supporting the fan wall in close engagement with the frame and alignable with the building opening. A shelf may be located on a lower portion of the frame opening along with a flange at least partially extending around the frame opening for receiving and supporting the fan in the frame and building openings in a secure fashion for air exhaust, intake and circulation.

A principal object and advantage of the present invention is that the fan and adaptor assembly provides air circulation within the building, air intake into the building and air exhaust from the building all in a single unit.

Another object and advantage of the present invention is that the fan is readily removed from the adaptor, turned around 180° and placed back into the adaptor for reversing the air flow with minimal attention and effort.

Another object and advantage of the present invention is that a building having the fan and adaptor assemblies within its outer walls will permit the owner to readily have air intake into the building in any direction, direct air exhaust from the building in any direction and permit air circulation within the building in a multiplicity of directions.

Another object and advantage of the present invention is that the shroud adaptor is readily economical and easy to manufacture thereby making the assembly economically affordable for many, if not all, farmers.

Yet another object and advantage of the present invention is that the fan shroud adaptor will receive existing fans with circumferential walls that will readily engage and fit within the adaptors central frame opening.

Another object and advantage of the present invention is that its use for poultry and livestock buildings will prevent heat stress, maintain production levels and control flying insects while keeping the ceilings, walls and floors moisture free, with consistent air temperature throughout and smelling free of ammonia during the winter months.

Another object and advantage of the present invention is that the shroud readily stacks or nests with a multiplicity of other shrouds for easy storage and transportation with minimal effort in assembly of its components.

Other objects and advantages will become apparent upon a review of the figures, the following specification and the appended claims.

DETAILED SPECIFICATION OF THE INVENTION

Figure 1:
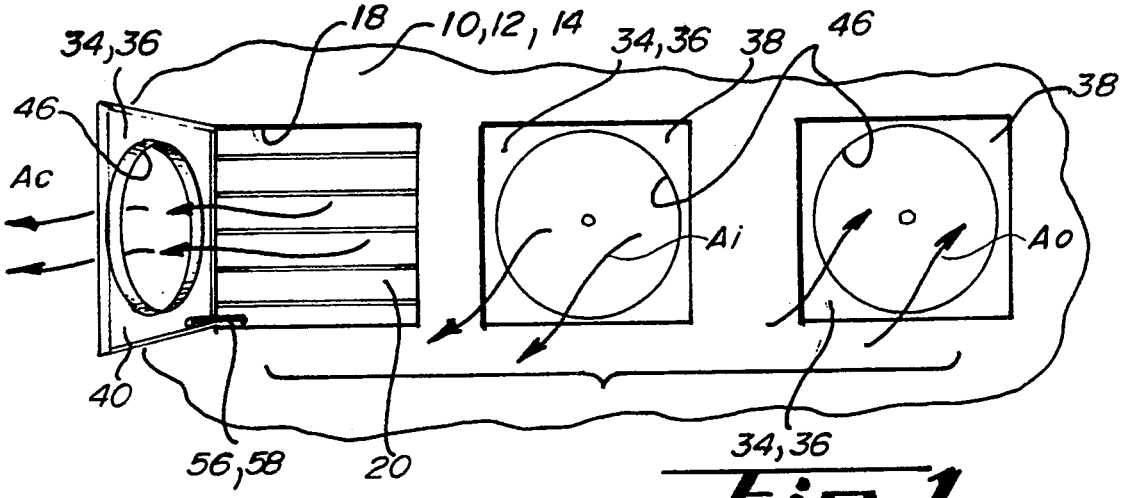
FIG. 1 is a schematic view of the three modes of operation of the fan and fan shroud adaptor assembly of the present invention.
Figure 2:
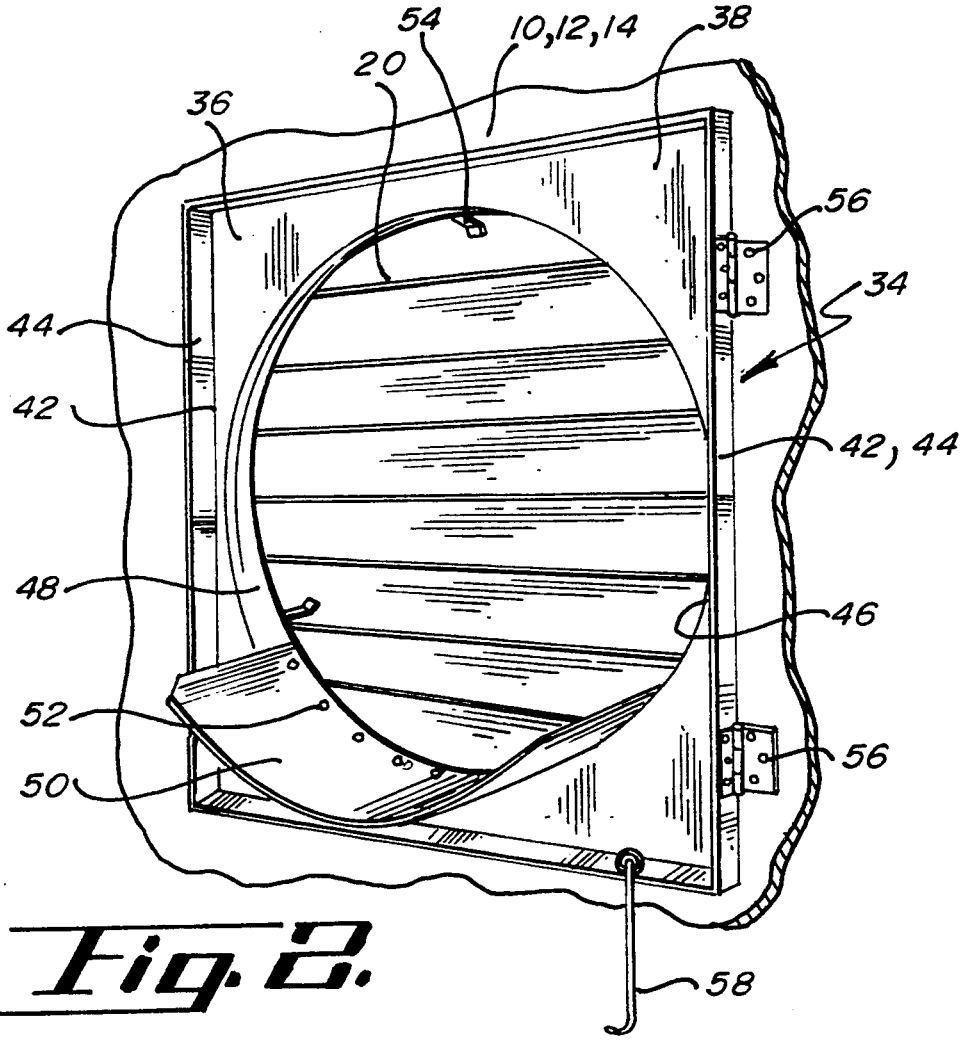
FIG. 2 is a perspective view of the fan shroud adaptor affixed, attached or hinged to the inner surface of a building wall in confronting relationship with a building opening through the wall.
Figure 4:
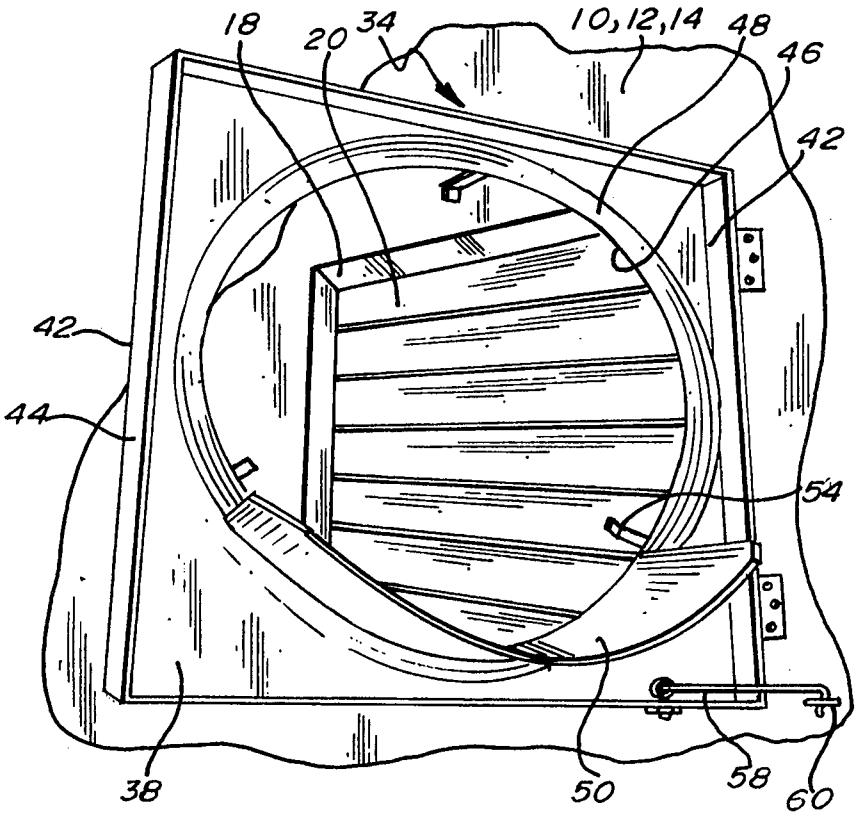
FIG. 4 is another perspective view of the fan shroud adaptor swung approximately 90° from the building wall and secured thereat suitably by a latch.
Figure 3:
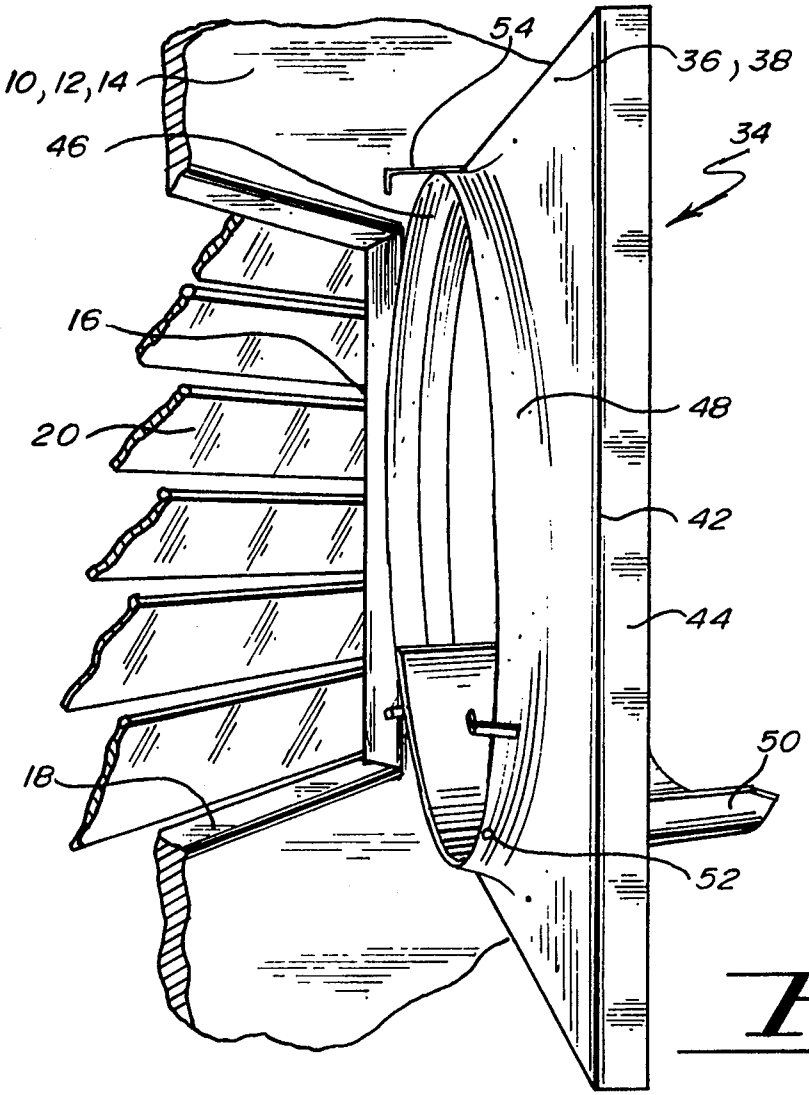
FIG. 3 is a perspective view of the fan shroud adaptor beginning to swing away from the building wall.

Generally referring to FIGS. 1–9, the present invention may be generally understood. Buildings 10 have walls 12 with an inside surface 14 and an outside surface 16. Openings 18 pass through the walls 12 and appropriately may be square as to easily conform with the stud structure within the wall. Shutters 20 may closed these openings from the outside. Agricultural buildings 10 commonly have problems in controlling the atmosphere therein. A circulation fan 22 may be used in combination with a fan shroud adaptor 34 in at least three combinations to control air intake (arrow $A_i$), air circulation (arrow $A_c$) and air exhaust (arrow $A_o$).

Figure 5:
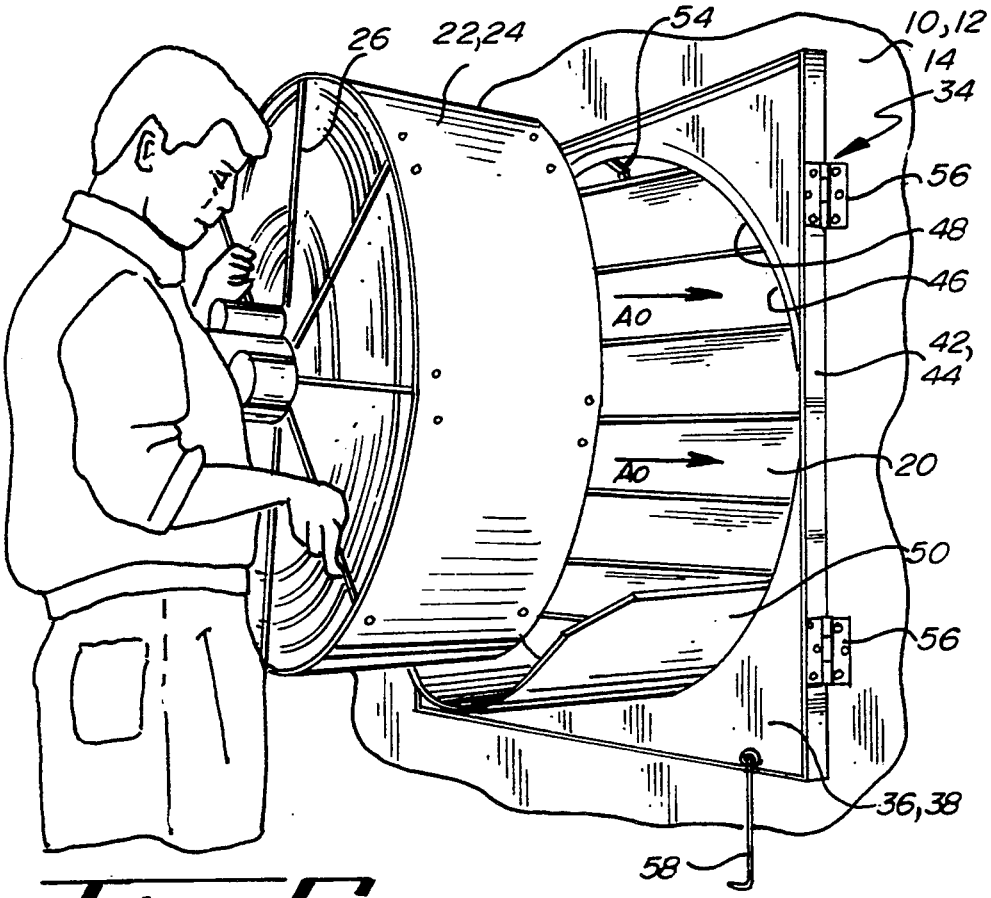
FIG. 5 is a perspective view of an individual loading an air circulation fan into the fan shroud adaptor for air exhaust.
Figure 6:
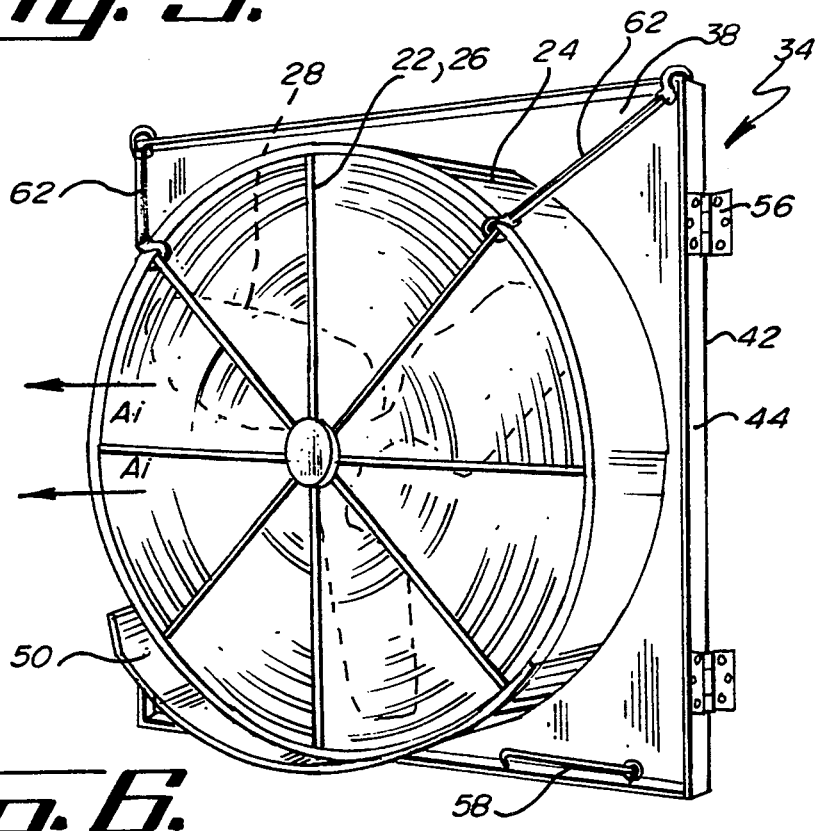
FIG. 6 is another perspective view of the fan shroud adaptor having an air circulation fan placed therein in the air intake mode.
Figure 7:
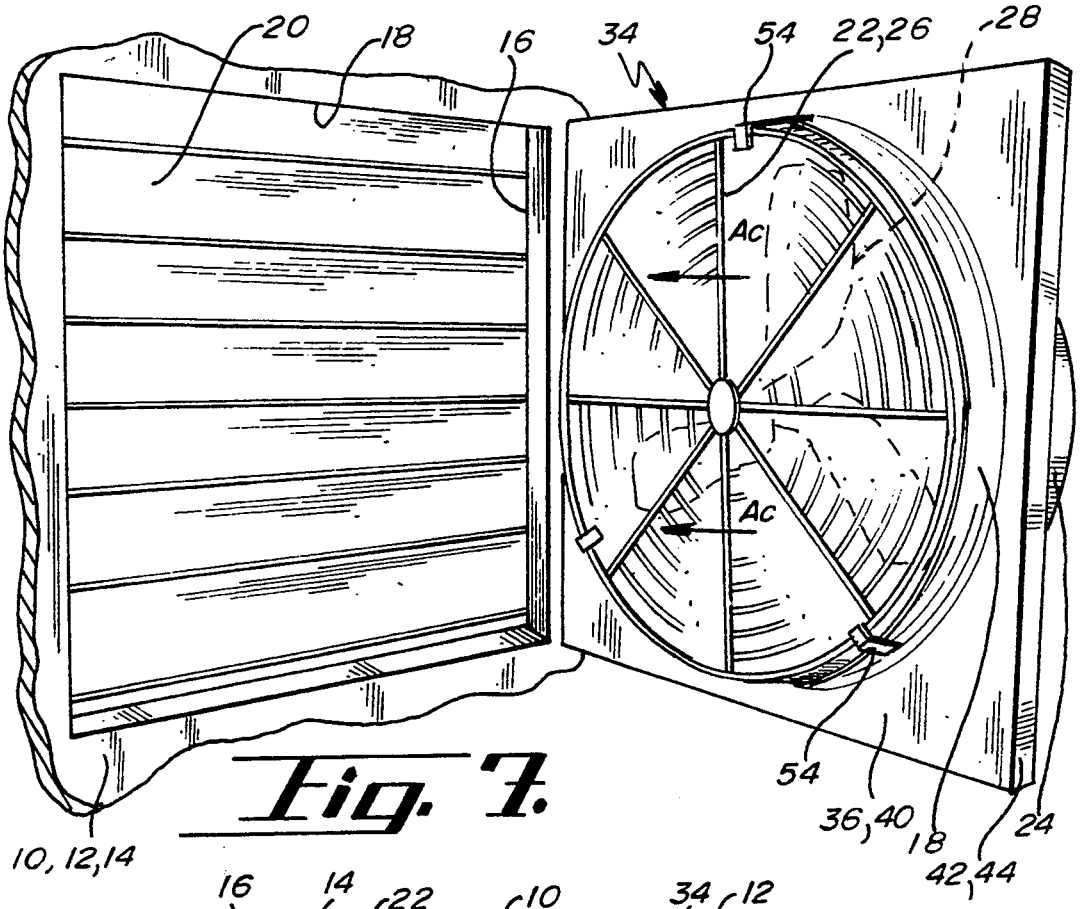
FIG. 7 is a perspective view of the fan shroud adaptor swung out and secured with an air circulation fan therein in the air circulation mode.

Specifically referring to FIGS. 5–7, an air circulation fan 22 has an open or closed circumferential wall 24 with its open ends closed by opposing grill faces 26 completely enclosing a fan blade 28 suitably driven by an electric motor. Funnel fans are also air circulation fans 22.

Referring to FIGS. 2–7, the fan shroud adaptor 34 may be understood. The adaptor 34 suitably may have a substantially flat frame 36 and be entirely constructed suitably out of galvanized metal or corrosion-resistant, high impact plastic of suitable strength. The frame 36 may have an inner side surface 38 and an outer side surface 40 along with peripheral edges 42 whereat a rib, ridge or flange 44 may be located to add strength and rigidity to the frame 36.

The frame 36 of the fan shroud adaptor 34 has a frame opening 46 which is complementary to the diameter of the circumferential wall 24 of fan 22 which will permit coaxial alignment and engaging receipt of the fan 22 within the frame opening 46. Around the frame opening 46 preferably is a smooth, funnel–like flange or venturi 48 which greatly assists in guiding a large fan, which illustratively may be 36" to 48" in diameter, readily into the frame opening 46. The funnel-like flange 48 also provides rigidity and strength to the frame 36. Suitably along a lower portion of frame opening 46 is located a shelf 50 which appropriately may be bolted or welded 52 to the funnel-like flange 48 adjacent the frame opening 46. The shelf 50 for the most part extends inwardly of the building suitably along the inside 38 of the frame 36. On the outside 40 of the frame 36 suitably may be located a stopping means, such as brackets or tabs 54, which suitably may be bolted or welded onto frame 36 adjacent opening 46 to prohibit the circulation fan 22 from passing completely through the frame opening 46. The brackets 54 and shelf 50 appropriately may be bolted rather than welded as to permit an easy nesting of a large number of the shroud adaptors 34 for easy transportation and simple assembly at the location of use.

Along the edges 42 of the frame 38 suitably may be located a means for securing the shroud adaptor 34 to the inside 14 of the building wall 12. For instance, screws may pass through the frame 36 into studs within the wall 12 adjacent the wall opening 18. Alternatively and as shown, hinges 56 may be utilized by their securement to the frame rib or flange 44 and the studs within the building wall 12. By this arrangement, the shroud adaptor 34 may be swung inwardly into the building 10 and secured in its substantially perpendicular relationship with respect to the wall 12 by way of a securing strut means, such as a latch and ring combination 58 and 60. Stretch cords 62 (FIG. 6) may also be utilized to secure the circulation fan 22 within the shroud assembly 34 and to prevent the fan 22 from vibrating out of the fan shroud adaptor 34.

Consequently, these means for supporting and/or fastening the fan 22 in the frame opening 46 may be flange 48, shelf 50 or cords 62.

After the fan shroud adaptor 34 has been connected to the building wall 12 in a confronting or closing relationship with respect to the suitably square building opening 18, the operation of the circulation fan 22 and fan shroud adaptor 34 assembly may be easily appreciated. The individual (FIG. 5) suitably orientates the fan 22 for guidance into the fan shroud adaptor opening 46 under the guidance of the funnel-like flange 48. The orientation of the fan is a simple matter as to whether the individual wishes to have the air brought into the building (arrow $A_i$) or have the air exhausted from the building (arrow $A_o$). Yet alternatively, with the fan shroud adaptor 34 swung inwardly and secured by latch securing means 58 and 60, the individual may circulate air within the building in either direction along the wall 12. As is obvious, the shutters 12 suitably are closed when the air flow is not being moved in or out of the building.

Figure 8:
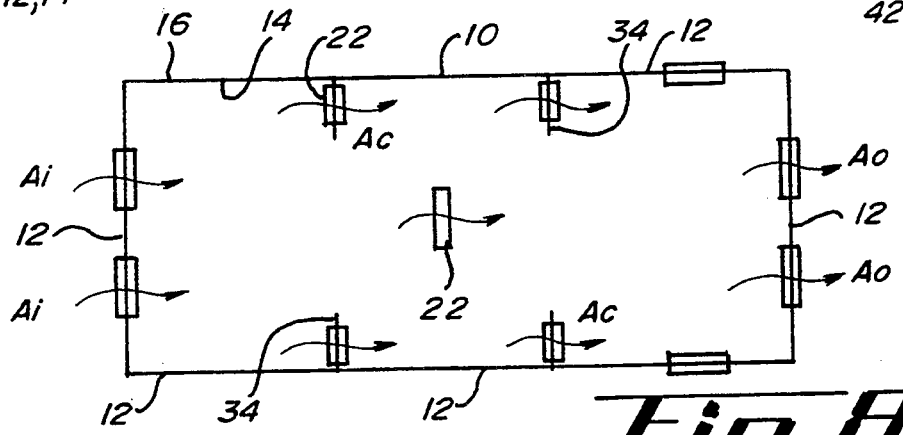
FIG. 8 is a schematic plan of a building utilizing the present invention to totally control the atmosphere therein.
Figure 9:
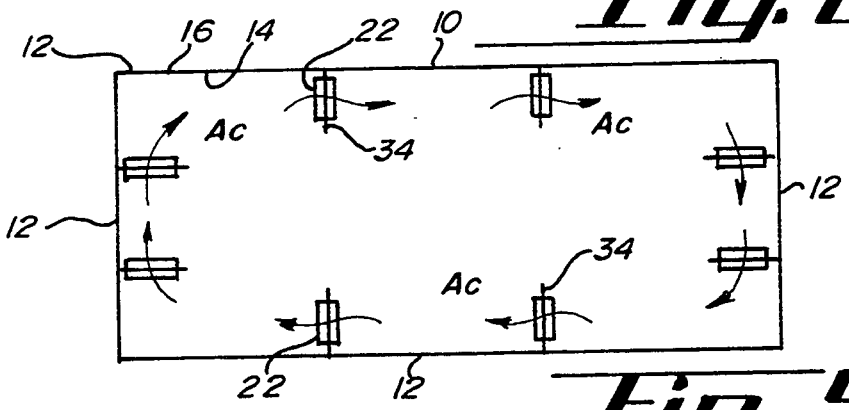
FIG. 9 is another schematic view similar to FIG. 8 showing the present invention's use in air circulation suitably in winter months.

Referring to FIGS. 1, 8 and 9, the infinite combinations of various configurations of the air circulation fan 22 and shroud adaptor 34 assembly may be understood. Air may be brought into the building 10 from any wall 12 as well as exhausted from the building 10 at any wall 12. For example, cooler outside air from the shady side of the building 10 may be drawn in, while putrid or warm air may be exhausted on an opposite wall 12 which may be sunny on the outside of the building 10.

The present invention may be embodied in other specific forms without departing from the spirit of essential attributes thereof; therefore, the illustrated embodiment should be considered in all respects as illustrative and not restrictive, reference being made to the appended claims rather than to the foregoing description to indicate the scope of the invention.

What is claimed:

1. A fan shroud adaptor for use with a fan having a circumferential wall for convertible fan use including air circulation within the building, air intake into the building and air exhaust from the building, comprising:

(a) a frame attachable to a building wall in confronting relationship with a building opening through the wall to the outside; and (b) an opening in the frame with a flange adjacent the opening adapted to assist in guiding the fan onto the frame adjacent the opening and to support and engagingly hold the circumferential wall of the fan in confronting relationship with the frame opening for air exhaust, intake and circulation.

2. The fan shroud adaptor of claim 1, wherein the opening is circular and the fan circumferential wall is circular for close engagement and support of the fan wall in the frame opening.

3. The fan shroud adaptor of claim 1, wherein the flange extends around the frame opening in a smooth funnel-like outwardly direction to assist in guiding the fan into the opening and to support and engagingly hold the fan wall therearound.

4. The fan shroud adaptor of claim 1, further comprising a shelf adjacent a lower portion of the frame opening to receive and support the fan in the frame opening.

5. The fan shroud adaptor of claim 1, further comprising stretch cords between the circumferential wall and the frame.

6. The fan shroud adaptor of claim 1, further comprising stop means on an inside of the frame adjacent the frame opening to prohibit the fan from passing through the frame opening.

7. The fan shroud adaptor of claim 1, wherein the frame has two side edges, one of which is hingedly attached to the building wall to permit the frame to swing inwardly of the building to a position to permit the fan to be used for air circulation in the building.

8. The fan shroud adaptor of claim 7, further comprising a securing means to maintain the frame in its inward position.

9. The fan shroud adaptor of claim 1, further comprising fastening means to hold the fan in the adaptor.

10. The fan shroud adaptor of claim 1, wherein the frame is substantially flat to lie along an inside surface of the building wall.

11. The fan shroud adaptor of claim 1, further comprising a shutter panel attachable to an outside surface of the building wall in confronting relationship with the building opening.

12. A fan shroud adaptor for use with a fan having a circumferential wall for convertible fan use including air intake into the building, air circulation within the building and air exhaust from the building, comprising:

(a) a substantially flat frame attachable to a building wall as to close a building opening through the wall to the outside; and (b) an opening in the frame with means to support the circumferential wall of the fan in the frame opening for air exhaust and circulation, and wherein the frame has two side edges, one of which is hingedly attached to the building wall to permit the frame to swing inwardly of the building to a position to also permit the fan to be used for air circulation in the building.

13. The fan shroud adaptor of claim 12, wherein the frame opening is circular and the fan circumferential wall is circular for close engagement and support of the fan wall in the frame opening.

14. The fan shroud adaptor of claim 12, wherein the means comprises a flange extending at least partially around the frame opening in a smooth, funnel-like outwardly direction to assist in guiding the fan into the frame opening and to support and engagingly hold the fan wall therearound.

15. The fan shroud of claim 12, wherein the means comprises a flange adjacent the opening adapted to assist in guiding the fan onto the frame adjacent the opening and to support and engagingly hold the circumferential wall of the fan in confronting relationship with the frame opening for air exhaust intake and circulation.

16. The fan shroud adaptor of claim 12, further comprising stop means on an inside of the frame adjacent the frame opening to prohibit the fan from passing through the frame opening.

17. The fan shroud of claim 12, further comprising a securing means to maintain the frame in its inward position.

18. The fan shroud of claim 12, further comprising stretch cords between the circumferential wall and the frame to hold the fan in the adaptor.

19. The fan shroud adaptor of claim 12, further comprising a shutter panel attachable to an outside surface of the building wall in confronting relationship with the building opening.

20. A fan shroud adaptor for use with a fan having a circumferential wall for convertible fan use including air circulation within the building, air intake into the building, and air exhaust from the building, comprising:

(a) a substantially flat frame attachable to a building wall in confronting relationship with a building opening through the wall to the outside; and (b) an opening in the frame with a flange adjacent the opening adapted to assist in guiding the fan onto the frame adjacent the opening and to support and engagingly hold the circumferential wall of the fan in close sealing engagement in the frame and the building wall openings for air exhaust, intake and circulation.

21. The fan shroud adaptor of claim 20, wherein the opening is circular and the fan circumferential wall is circular for close engagement and support of the fan wall in the frame and the building openings.

22. The fan shroud adaptor of claim 20, wherein the flange extends around the frame opening in a smooth, funnel-like outwardly direction to assist in guiding the fan into the opening and to support and engagingly hold the fan wall therearound.

23. The fan shroud adaptor of claim 20, further comprising a shelf adjacent a lower portion of the frame opening to receive and support the fan in the frame opening.

24. The fan shroud adaptor of claim 20, further comprising stop means on an inside of the frame adjacent the frame opening to prohibit the fan from passing through the frame opening.

25. The fan shroud adaptor of claim 20, wherein the frame has two side edges, one of which is hingedly attached to the building wall to permit the frame to swing inwardly of the building to a position to permit the fan to be used for air circulation in the building.

26. The fan shroud adaptor of claim 25, further comprising a securing means to maintain the frame in its inward position.

27. The fan shroud adaptor of claim 20, further comprising fastening means to hold the fan in adaptor.

28. The fan shroud adaptor of claim 20, further comprising a shutter panel attachable to an outside surface of the building wall in confronting relationship with the building opening.

29. A combination fan and fan shroud adaptor assembly for air-intake, air circulation and air exhaust within a building, comprising:

(a) a fan with a circumferential wall and front and rear grill faces;

(b) a frame attachable to a building wall in confronting relationship with a building opening through the wall to the outside as to close the building opening;

(c) an opening in the frame slightly larger than the fan circumferential wall for receiving and supporting the fan wall in close engagement with the frame; and (d) a flange adjacent the opening adapted to assist in guiding the fan onto the frame adjacent the opening and to support and engagingly hold the circumferential wall of the fan in confronting relationship with the frame opening.

30. The fan shroud adaptor of claim 29, wherein the opening is circular and the fan circumferential wall is circular for close engagement and support of the fan wall in the frame opening.

31. The fan shroud adaptor of claim 29, wherein the flange extends at least partially around and adjacent the frame opening to assist in guiding the fan into the opening and to support and engagingly hold the fan in the frame opening.

32. The fan shroud adaptor of claim 29, further comprising a shelf adjacent a lower portion of the frame opening to receive and support the fan in the frame opening.

33. The fan shroud adaptor of claim 29, further comprising stop means on an inside of the frame adjacent the frame opening to prohibit the fan from passing through the frame opening.

34. The fan shroud adaptor of claim 29, wherein the frame has two side edges, one of which is hingedly attached to the building wall to permit the frame to swing inwardly of the building to a position to permit the fan to be used for air circulation in the building.

35. The fan shroud adaptor of claim 34, further comprising a securing means to maintain the frame in its inward position.

36. The fan shroud adaptor of claim 29, further comprising fastening means to hold the fan in the adaptor.

37. The fan shroud adaptor of claim 29, wherein the frame is substantially flat to lie along an inside surface of the building wall.

38. The fan shroud adaptor of claim 29, further comprising a shutter panel attachable to an outside surface of the building wall in confronting relationship with the building opening.

* * * * *